US011150574B2

(12) United States Patent
Shimizu et al.

(10) Patent No.: US 11,150,574 B2
(45) Date of Patent: Oct. 19, 2021

(54) IMAGE FORMING APPARATUS

(71) Applicant: KYOCERA Document Solutions Inc., Osaka (JP)

(72) Inventors: Tamotsu Shimizu, Osaka (JP); Kazunori Tanaka, Osaka (JP); Kanako Morimoto, Osaka (JP); Shiro Kaneko, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/178,577

(22) Filed: Feb. 18, 2021

(65) Prior Publication Data

US 2021/0263442 A1 Aug. 26, 2021

(30) Foreign Application Priority Data

Feb. 21, 2020 (JP) ..... JP2020-027940

(51) Int. Cl.
*G03G 15/00* (2006.01)
*G03G 15/06* (2006.01)

(52) U.S. Cl.
CPC ..... *G03G 15/065* (2013.01); *G03G 15/50* (2013.01); *G03G 15/80* (2013.01)

(58) Field of Classification Search
USPC ..... 399/55
See application file for complete search history.

(56) References Cited

U.S. PATENT DOCUMENTS

2005/0281575 A1* 12/2005 Yoshizuka ..... G03G 15/5041 399/55
2009/0016750 A1* 1/2009 Kobayashi ..... G03G 15/065 399/49
2021/0149321 A1* 5/2021 Shimizu ..... G03G 15/065
2021/0173321 A1* 6/2021 Fukushima ..... G03G 15/065
2021/0173330 A1* 6/2021 Toyota ..... G03G 15/0907
2021/0263441 A1* 8/2021 Shimizu ..... G03G 15/5062

FOREIGN PATENT DOCUMENTS

JP 2005-352409 12/2005

* cited by examiner

*Primary Examiner* — Q Grainger
(74) *Attorney, Agent, or Firm* — Lex IP Meister, PLLC

(57) ABSTRACT

An image forming apparatus includes a plurality of image forming units, a developing voltage power supply, a current detection unit, and a control unit. The image forming units form an image by superimposing a toner image of a same color and a same type, and substantially same development conditions are set to evenly divide an image density among the image forming units. The control unit detects whether there is an anomaly in the image forming unit based on detecting a DC component of developing current, being either of current flowing through a non-exposed portion of an image carrier during image formation, and current flowing through an exposed portion of the image carrier. When an anomaly is detected in any image forming unit, the control unit inhibits use of the image forming unit, and resets the development conditions to evenly divide an image density among the usable image forming units.

9 Claims, 4 Drawing Sheets

IMAGE FORMING APPARATUS

INCORPORATION BY REFERENCE

This application is based upon, and claims the benefit of priority from, corresponding Japanese Patent Application No. 2020-027940 filed in the Japan Patent Office on Feb. 21, 2020, the entire contents of which are incorporated herein by reference.

BACKGROUND

Field of the Invention

The present disclosure relates to an image forming apparatus such as a copying machine, a printer, a facsimile machine, and a multifunction device thereof provided with an image carrier, and particularly relates to an image forming apparatus that performs image formation by filling a plurality of developing devices with toner of a same color and a same type.

Description of Related Art

In a typical image forming apparatus using an electrophotographic process, an image forming process is performed in which an electrostatic latent image is formed by irradiating an image carrier such as a photoconductor drum that is uniformly charged by a charging device with laser light from an exposure device, after toner is adhered to the electrostatic latent image by the developing device to form a toner image, the toner image is transferred onto paper (recording medium), and a fixing process is performed.

In such an image forming apparatus, generally, a developing device that develops black toner is mounted in an image forming apparatus for forming a monochromatic image, and developing devices that develop toners of a plurality of colors (for example, yellow, magenta, cyan, and black) are mounted in an image forming apparatus for forming a color image.

SUMMARY

A first configuration according to the present disclosure is directed to an image forming apparatus including a plurality of image forming units, a developing voltage power supply, a current detection unit, and a control unit. The image forming units each includes an image carrier having a photosensitive layer formed on a surface thereof, and a developing device including a developer carrier that is disposed to face the image carrier and carries a developer containing toner, and configured to form an image by adhering the toner to an electrostatic latent image formed on the image carrier, and forms an image by superimposing a toner image of a same color. The plurality of image forming units use the developer containing the toner of a same color and a same type, and substantially same development conditions are set to evenly divide an image density among the image forming units. The developing voltage power supply applies, to the developer carrier, a developing voltage acquired by superimposing an AC voltage on a DC voltage. The current detection unit detects a DC component of developing current that flows when the developing voltage is applied to the developer carrier. The control unit controls the image forming units and the developing voltage power supply. The control unit detects whether there is an anomaly in each of the image forming units, based on at least one of white background portion current I1 being a DC component of developing current flowing through a non-exposed portion of the image carrier detected by the current detection unit during image formation, and image portion current I2 being a DC component of developing current flowing through an exposed portion of the image carrier. When an anomaly is detected in any of the image forming units, the control unit inhibits use of the image forming unit, and resets the development conditions to evenly divide the image density among the usable image forming units.

DETAILED DESCRIPTION

Figure 1:
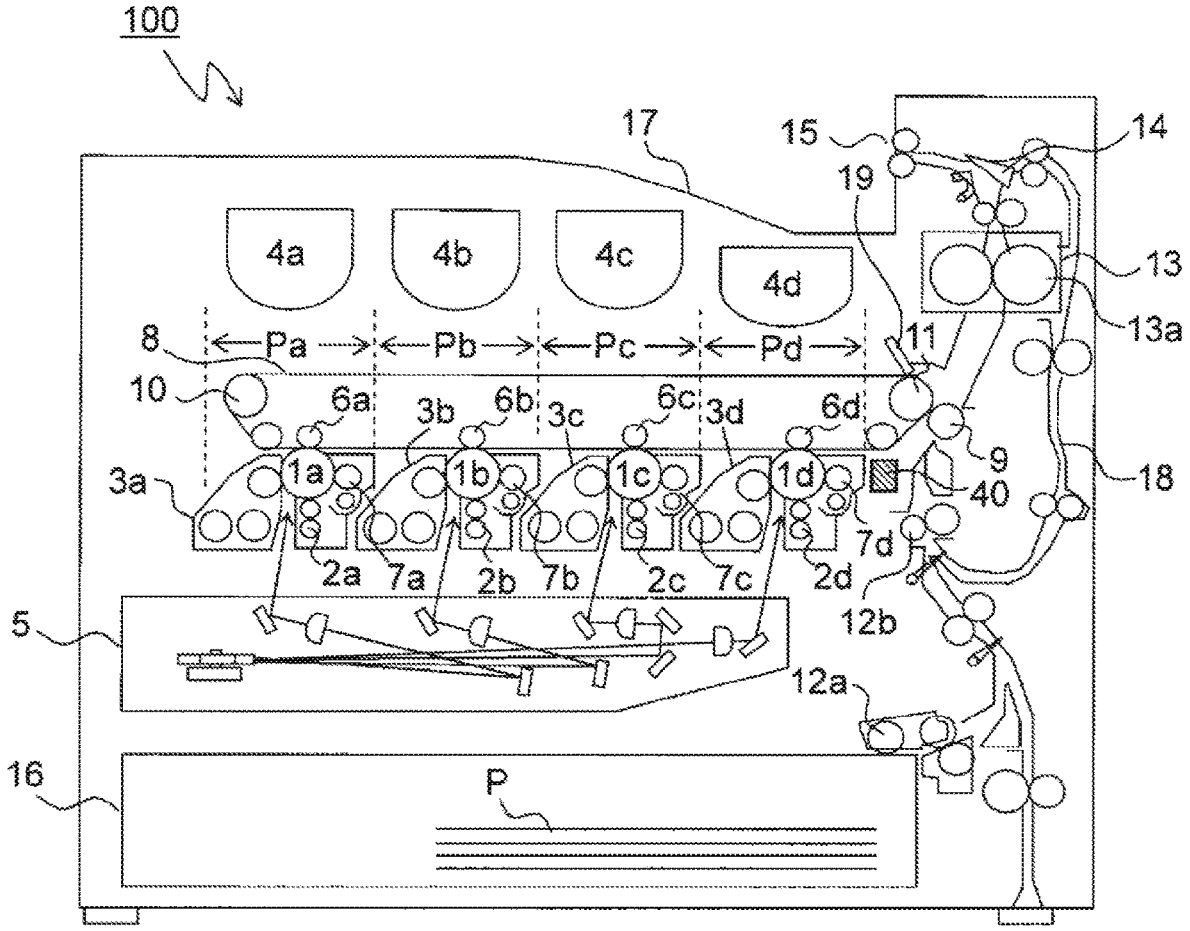
FIG. 1 is a side sectional view showing an internal configuration of an image forming apparatus 100 according to one embodiment of the present disclosure.

In the following, an embodiment according to the present disclosure is described with reference to the drawings. FIG. 1 is a cross-sectional view showing an internal structure of an image forming apparatus 100 according to one embodiment of the present disclosure. In a main body of the image forming apparatus 100 (herein, a monochromatic printer), four image forming units Pa, Pb, Pc and Pd are disposed in order from an upstream side (left side in FIG. 1) in a transport direction. These image forming units Pa to Pd are provided in association with an image of a same color (black), and a black image is sequentially formed by each step of charging, exposure, development, and transfer.

Photoconductor drums (image carriers) 1*a*, 1*b*, 1*c* and 1*d* that carry visible images (toner images) of a same color are disposed in these image forming units Pa to Pd, and an intermediary transfer belt (intermediate transfer body) 8 that rotates counterclockwise in FIG. 1 by a belt drive motor (not shown) is provided adjacent to the image forming units Pa to Pd. The toner images formed on the photoconductor drums 1*a* to 1*d* are sequentially and primarily transferred and superimposed onto the intermediary transfer belt 8 that moves in contact with each of the photoconductor drums 1*a* to 1*d*. Thereafter, the toner images that are primarily transferred onto the intermediary transfer belt 8 are secondarily transferred onto transfer paper P as one example of a recording medium by a secondary transfer roller 9. Further, the transfer paper P on which the toner images are secondarily transferred is discharged from the main body of the image forming apparatus 100 after the toner images are fixed in a fixing unit 13. An image forming process for the photoconductor drums 1*a* to 1*d* is performed while rotating the photoconductor drums 1*a* to 1*d* clockwise in FIG. 1.

Transfer paper P on which toner images are secondarily transferred is accommodated in a paper cassette 16, which is disposed in a lower part of the main body of the image forming apparatus 100, and is transported to a nip portion between the secondary transfer roller 9 and a driving roller 11 of the intermediary transfer belt 8 via a paper feed roller 12*a* and a registration roller pair 12*b*. A sheet made of dielectric resin is used for the intermediary transfer belt 8, and a seamless belt is mainly used. Further, a blade-shaped belt cleaner 19 for removing toner and the like remaining on a surface of the intermediary transfer belt 8 is disposed on a downstream side of the secondary transfer roller 9.

Next, the image forming units Pa to Pd are described. Around and under the rotatably disposed photoconductor drums 1*a* to 1*d*, there are provided charging devices 2*a*, 2*b*, 2*c*, and 2*d* that electrostatically charge the photoconductor drums 1*a* to 1*d*, an exposure device 5 that exposes the photoconductor drums 1*a* to 1*d* to light of image information, developing devices 3*a*, 3*b*, 3*c*, and 3*d* that form toner images on the photoconductor drums 1*a* to 1*d*, and cleaning devices 7*a*, 7*b*, 7*c*, and 7*d* that remove a developer (toner) remaining on the photoconductor drums 1*a* to 1*d*.

When image data are input from a host device such as a personal computer, first, surfaces of the photoconductor drums 1*a* to 1*d* are uniformly charged by the charging devices 2*a* to 2*d*. Next, the exposure device 5 irradiates light according to the image data to form an electrostatic latent image according to the image data on the photoconductor drums 1*a* to 1*d*. Each of the developing devices 3*a* to 3*d* is filled with a specific amount of a two-component developer containing black toner. When a ratio of toner in the two-component developer filled in each of the developing devices 3*a* to 3*d* falls below a prescribed value by formation of a toner image to be described later, toner is replenished from toner containers 4*a* to 4*d* to the developing devices 3*a* to 3*d*. The toner in the developer is supplied onto the photoconductor drums 1*a* to 1*d* by the developing devices 3*a* to 3*d*, and is electrostatically adhered, whereby a toner image according to the electrostatic latent image formed by exposure from the exposure device 5 is formed.

Then, an electric field is applied between primary transfer rollers 6*a* to 6*d* and the photoconductor drums 1*a* to 1*d* by the primary transfer rollers 6*a* to 6*d* at a specific transfer voltage, and black toner images on the photoconductor drums 1*a* to 1*d* are primarily transferred onto the intermediary transfer belt 8. These images are formed with a specific positional relationship that is determined in advance. Thereafter, in preparation for subsequent formation of a new electrostatic latent image, toner and the like remaining on the surfaces of the photoconductor drums 1*a* to 1*d* after the primary transfer are removed by the cleaning devices 7*a* to 7*d*.

The intermediary transfer belt 8 is stretched between a driven roller 10 on the upstream side, and the driving roller 11 on the downstream side. When the intermediary transfer belt 8 starts to rotate counterclockwise as the driving roller 11 rotates by the belt drive motor (not shown), transfer paper P is transported at a specific timing from a registration roller pair 12*b* to a nip portion (secondary transfer nip portion) between the driving roller 11 and the secondary transfer roller 9, which is provided adjacent to the driving roller 11, and toner images on the intermediary transfer belt 8 are secondarily transferred onto the transfer paper P. The transfer paper P on which the toner images are secondarily transferred is transported to the fixing unit 13.

The transfer paper P transported to the fixing unit 13 is heated and pressurized by a fixing roller pair 13*a* to fix the toner images on a surface of the transfer paper P, and a specific monochromatic image is formed. The transfer paper P on which the monochromatic image is formed has its transport direction determined by branching portions 14 branched in a plurality of directions, and is discharged to a discharge tray 17 by a discharge roller pair 15 as it is (or after the transfer paper P is sent to a double-sided transport path 18, and an image is formed on both surfaces thereof).

Further, an image density sensor 40 is disposed on the downstream side of the image forming unit 1*d* and at a position facing the intermediary transfer belt 8. As the image density sensor 40, an optical sensor including a light emitting element composed of an LED or the like, and a light receiving element composed of a photodiode or the like is generally used. In measuring an amount of toner adhering to the intermediary transfer belt 8, when measurement light is irradiated from the light emitting element to each of reference images formed on the intermediary transfer belt 8, the measurement light is incident to the light receiving element as light reflected by the toner, and light reflected on the belt surface.

The reflected light from the toner and the belt surface includes specularly reflected light and diffusely reflected light. The specularly reflected light and the diffusely reflected light are separated by a polarization separation prism, and then incident on individual light receiving elements. Each of the light receiving elements photoelectrically converts the received specularly reflected light and diffusely reflected light, and outputs an output signal to a main control unit 80 (see FIG. 3). Then, the toner amount is detected from a characteristic change of the output signals of the specularly reflected light and the diffusely reflected light, and density correction (calibration) is performed by adjusting a characteristic value and the like of a developing voltage in comparison with a reference density that is determined in advance.

Figure 2:
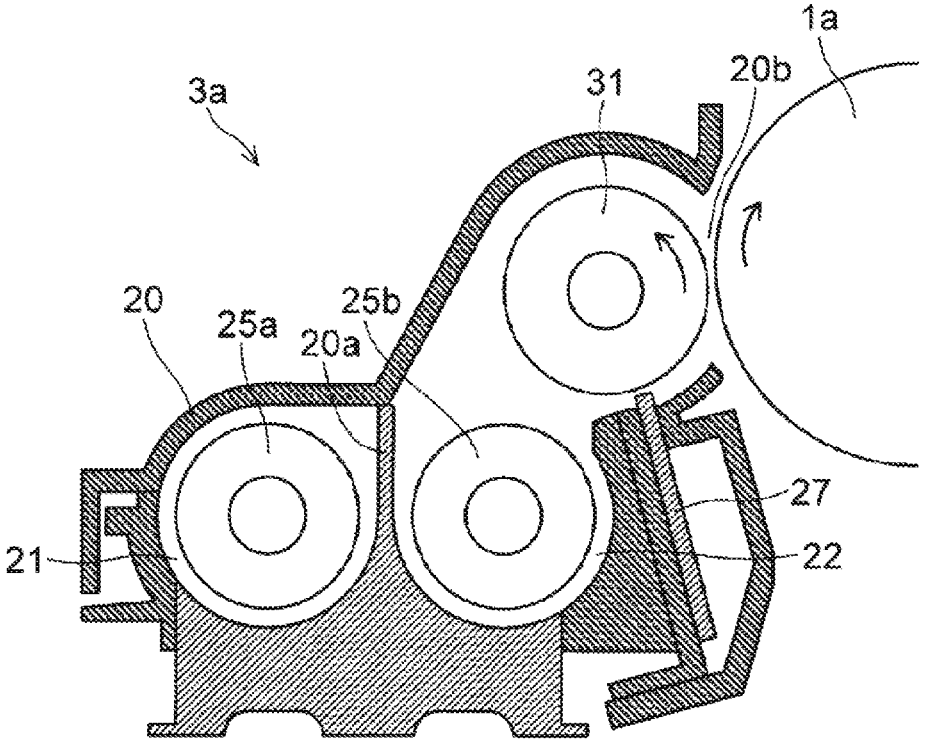
FIG. 2 is a side sectional view of a developing device 3*a* mounted in the image forming apparatus 100.

FIG. 2 is a side sectional view of the developing device 3*a* mounted in the image forming apparatus 100. In the following description, the developing device 3*a* disposed in the image forming unit Pa in FIG. 1 is exemplified. However, since configurations of the developing devices 3*b* to 3*d* disposed in the image forming units Pb to Pd are basically similar to the above, description thereof is omitted.

As shown in FIG. 2, the developing device 3*a* includes a developing container 20 in which a two-component developer (hereinafter, simply referred to as a developer) containing magnetic carrier and toner is stored, and the developing container 20 is divided into a stirring transport chamber 21 and a supply transport chamber 22 by a partition wall 20*a*. A stirring transport screw 25*a* and a supply transport screw 25*b* for mixing toner to be supplied from the toner container 4*a* (see FIG. 1) with magnetic carrier to stir and charge the toner are respectively and rotatably disposed in the stirring transport chamber 21 and the supply transport chamber 22. In the present embodiment, a two-component developer composed of positively charged toner having an average particle diameter of 6.8 μm, and ferrite/resin coated carrier having an average particle diameter of 35 μm is used, and a toner density (weight ratio of toner to magnetic carrier) is set to 6%.

Then, the developer is transported in the axial direction (direction perpendicular to the plane of FIG. 2) while being stirred by the stirring transport screw 25*a* and the supply transport screw 25*b*, and circulates between the stirring transport chamber 21 and the supply transport chamber 22 via an unillustrated developer passage path, which is formed at both ends of the partition wall 20*a*. Specifically, a circulation path for the developer is formed within the developing container 20 by the stirring transport chamber 21, the supply transport chamber 22, and the developer passage path.

The developing container 20 extends obliquely upward to the right in FIG. 2, and a developing roller 31 is disposed obliquely upward to the right of the supply transport screw 25*b* within the developing container 20. Then, a part of an outer peripheral surface of the developing roller 31 is exposed through an opening 20*b* of the developing container 20, and faces the photoconductor drum 1*a*. The developing roller 31 rotates counterclockwise in FIG. 2. In the present embodiment, a peripheral speed ratio of the developing roller 31 to the photoconductor drum 1*a* is set to 1.8 (trail rotation at the opposite position), and a distance between the developing roller 31 and the photoconductor drums 1*a* to 1*d* is set to 0.30 mm.

The developing roller 31 is constituted of a cylindrical developing sleeve that rotates counterclockwise in FIG. 2, and a magnet (not shown) having a plurality of magnetic poles fixed within the developing sleeve. Although a developing sleeve having a knurled surface is used herein, it is also possible to use a developing sleeve having a large number of concave shapes (dimples) on a surface thereof, a developing sleeve having a blasted surface, and a developing sleeve having a blasted surface or a plated surface in addition to a knurled shape or a concave shape. In the present embodiment, a developing roller 31 having a diameter of 20 mm in which eighty rows of recesses are formed in a circumferential direction by knurling and blasting is used, and a developer transport amount by the developing roller 31 is set to 250 to 300 g/m$^2$.

Further, a regulation blade 27 is attached to the developing container 20 along the longitudinal direction of the developing roller 31 (perpendicular to the plane of FIG. 2). A slight clearance (gap) is formed between a tip of the regulation blade 27 and a surface of the developing roller 31. In the present embodiment, a magnetic blade made of stainless steel (SUS430) is used as the regulation blade 27.

Figure 3:
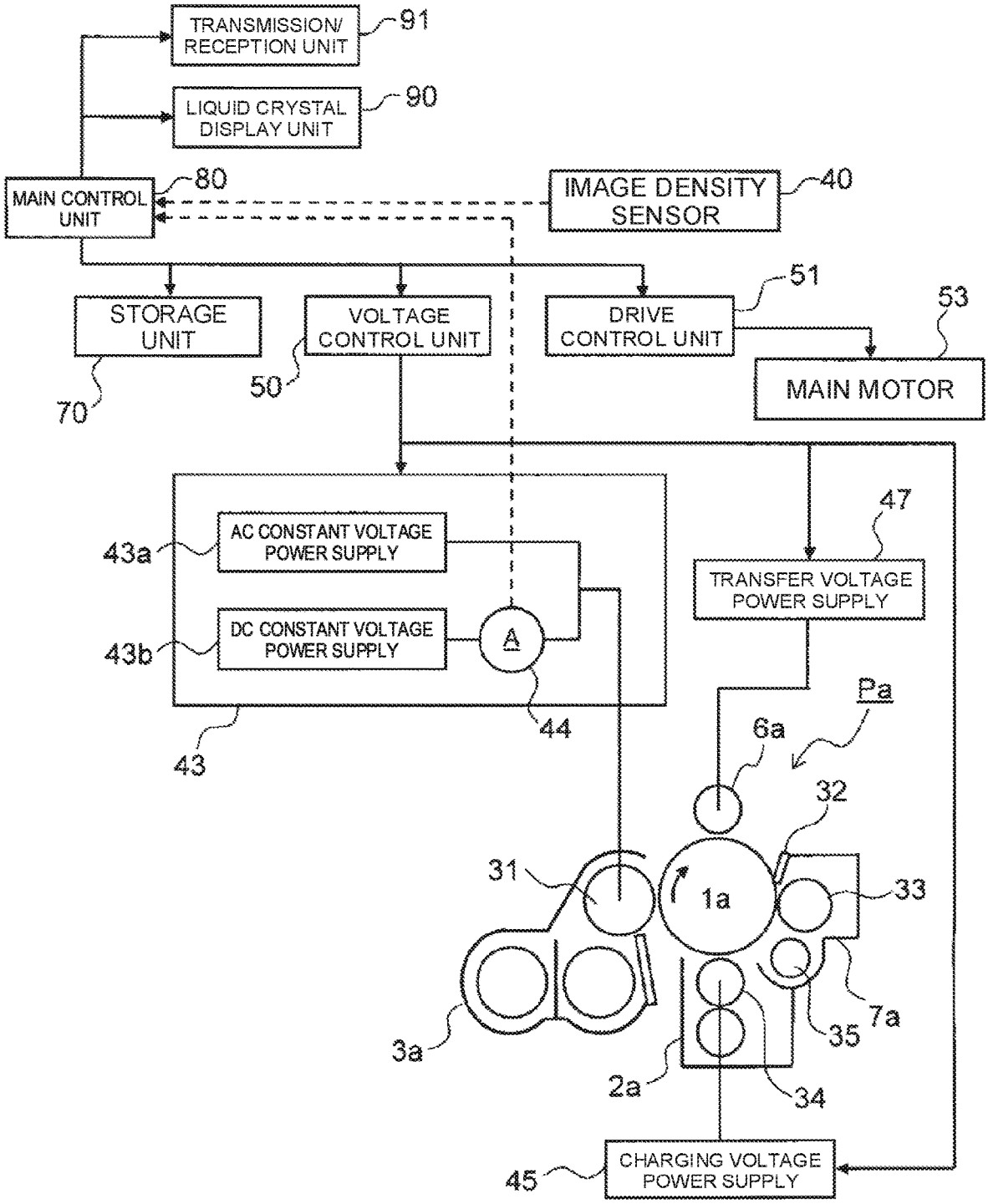
FIG. 3 is a diagram showing a configuration and a control path of an image forming unit Pa.

A developing voltage including a DC voltage Vdc and an AC voltage Vac is applied to the developing roller 31 by a developing voltage power supply 43 (see FIG. 3). As the development voltage, for example, a voltage acquired by superimposing an AC voltage Vac of a rectangular wave having a frequency of 5 kHz, Vpp=1100 V, and Duty=50% on a DC voltage Vdc is used.

FIG. 3 is a diagram showing a configuration and a control path of the image forming unit Pa including the developing device 3*a*. In the following description, the configuration and the control path of the image forming unit Pa are described. However, since configurations and control paths of the image forming units Pb to Pd are similar to the above, description thereof is omitted.

The developing roller 31 is connected to the developing voltage power supply 43 that generates a vibration voltage in which a DC voltage and an AC voltage are superimposed. The developing voltage power supply 43 includes an AC constant voltage power supply 43*a* and a DC constant voltage power supply 43*b*. The AC constant voltage power supply 43*a* outputs a sinusoidal AC voltage generated from a low-voltage DC voltage, which is pulse-modulated by using a step-up transformer (not shown). The DC constant voltage power supply 43*b* outputs a DC voltage acquired by rectifying a sinusoidal AC voltage generated from a low-voltage DC voltage, which is pulse-modulated by using a step-up transformer.

The developing voltage power supply 43 outputs a developing voltage acquired by superimposing an AC voltage on a DC voltage from the AC constant voltage power supply 43*a* and the DC constant voltage power supply 43*b* during image formation. A current detection unit 44 detects a value of DC current flowing between the developing roller 31 and the photoconductor drum 1*a*.

A charging voltage power supply 45 applies, to a charging roller 34 of the charging device 2*a*, a charging voltage in which an AC voltage is superimposed on a DC voltage. The configuration of the charging voltage power supply 45 is similar to that of the developing voltage power supply 43. A transfer voltage power supply 47 applies a primary transfer voltage and a secondary transfer voltage to the primary transfer rollers 6*a* to 6*d* and the secondary transfer roller 9 (see FIG. 1), respectively.

The cleaning device 7*a* includes a cleaning blade 32 that removes residual toner on the surface of the photoconductor drum 1*a*, a rubbing roller 33 that removes residual toner on the surface of the photoconductor drum 1*a*, and rubbing and polishing the surface of the photoconductor drum 1*a*, and a transport spiral 35 that discharges residual toner removed from the photoconductor drum 1*a* by the cleaning blade 32 and the rubbing roller 33 to the outside of the cleaning device 7*a*.

Next, a control system of the image forming apparatus 100 is described with reference to FIG. 3. The image forming apparatus 100 is provided with the main control unit 80 constituted of a CPU and the like. The main control unit 80 is connected to a storage unit 70 including a ROM, a RAM, and the like. The main control unit 80 controls, based on a control program and control data stored in the storage unit 70, each unit of the image forming apparatus 100 (charging devices 2*a* to 2*d*, developing devices 3*a* to 3*d*, exposure device 5, primary transfer rollers 6*a* to 6*d*, cleaning devices 7*a* to 7*d*, secondary transfer roller 9, fixing unit 13, developing voltage power supply 43, current detection unit 44, charging voltage power supply 45, transfer voltage power supply 47, voltage control unit 50, drive control unit 51, and the like).

The voltage control unit 50 controls the developing voltage power supply 43 that applies a developing voltage to the developing roller 31, the charging voltage power supply 45 that applies a charging voltage to the charging roller 34, and the transfer voltage power supply 47 that applies a transfer voltage to the primary transfer rollers 6*a* to 6*d* and the secondary transfer roller 9. The drive control unit 51 controls a main motor 53 that rotationally drives the photoconductor drums 1*a* to 1*d*. The voltage control unit 50 and the drive control unit 51 may be constituted of a control program stored in the storage unit 70.

A liquid crystal display unit 90 and a transmission/reception unit 91 are connected to the main control unit 80. The liquid crystal display unit 90 functions as a touch panel for the user to perform various settings of the image forming apparatus 100, and displays a state of the image forming apparatus 100, an image forming status, the number of prints, and the like. The transmission/reception unit 91 communicates with the outside by using a telephone line or an Internet line.

The image forming apparatus 100 according to the present embodiment is provided with four developing devices 3*a* to 3*d* filled with toner of a same color, and developing is performed by distributing an amount of toner necessary for forming an image at a target density for each of the developing devices 3*a* to 3*d*. Specifically, when only A is necessary as a toner development amount for forming an image at a target density, and developing is performed by using the four developing devices 3*a* to 3*d*, developing is performed by distributing the toner development amount by A/4 for each of the developing devices 3*a* to 3*d*.

A developing method including a plurality of (herein, four) developing devices 3*a* to 3*d* filled with toner of a same color and a same type is advantageous when a frequency with which an image having a high printing rate is continued is high. When the printing rate is high, a difference in the image density is likely to occur in the axial direction of the developing roller 31. As a result, it becomes difficult to reproduce uniformity with only one developing device. In view of the above, by superimposing a halftone image by the plurality of developing devices 3*a* to 3*d*, uniformity can be reproduced. Further, in some cases, by setting a transport direction of a developer in stirring sections of two of the four developing devices 3*a* to 3*d* (for example, the developing devices 3*b* and 3*d*) in the opposite direction, image uniformity in the axial direction of the developing roller 31 can be further improved.

As described above, in a method of forming an image by superimposing a toner image of a same color a plurality of times, when an anomaly occurs in any of the developing devices 3*a* to 3*d*, it is preferable to form an image by stopping use of the image forming units Pa to Pd including the anomalous developing devices 3*a* to 3*d*, and using the other image forming units Pa to Pd. In addition, the anomaly may be recovered by causing the anomalous developing devices 3*a* to 3*d* to perform an aging operation or a forcible ejection operation of toner while the anomalous developing devices 3*a* to 3*d* are kept in a stopped state or are not in use. In this case, it is necessary to resume the image forming units Pa to Pd in an unused state.

In order to determine stopping or resuming the image forming units Pa to Pd as described above, it is necessary to detect in which one of the image forming units Pa to Pd, an anomaly has occurred, or an anomaly has been resolved. However, when image formation is performed by using the image forming units Pa to Pd including the developing devices 3*a* to 3*d* filled with toner of a same color, occurrence of an anomaly or recovery of the image forming units Pa to Pd cannot be easily detected.

In view of the above, in the image forming apparatus 100 according to the present embodiment, a DC component of developing current flowing between the developing rollers 31 of the developing devices 3*a* to 3*d* and the photoconductor drums 1*a* to 1*d* during image formation is measured, and anomalous image forming units Pa to Pd are detected, based on the measured DC component of developing current. In the following, a method of detecting anomalous image forming units Pa to Pd is described.

Figure 4:
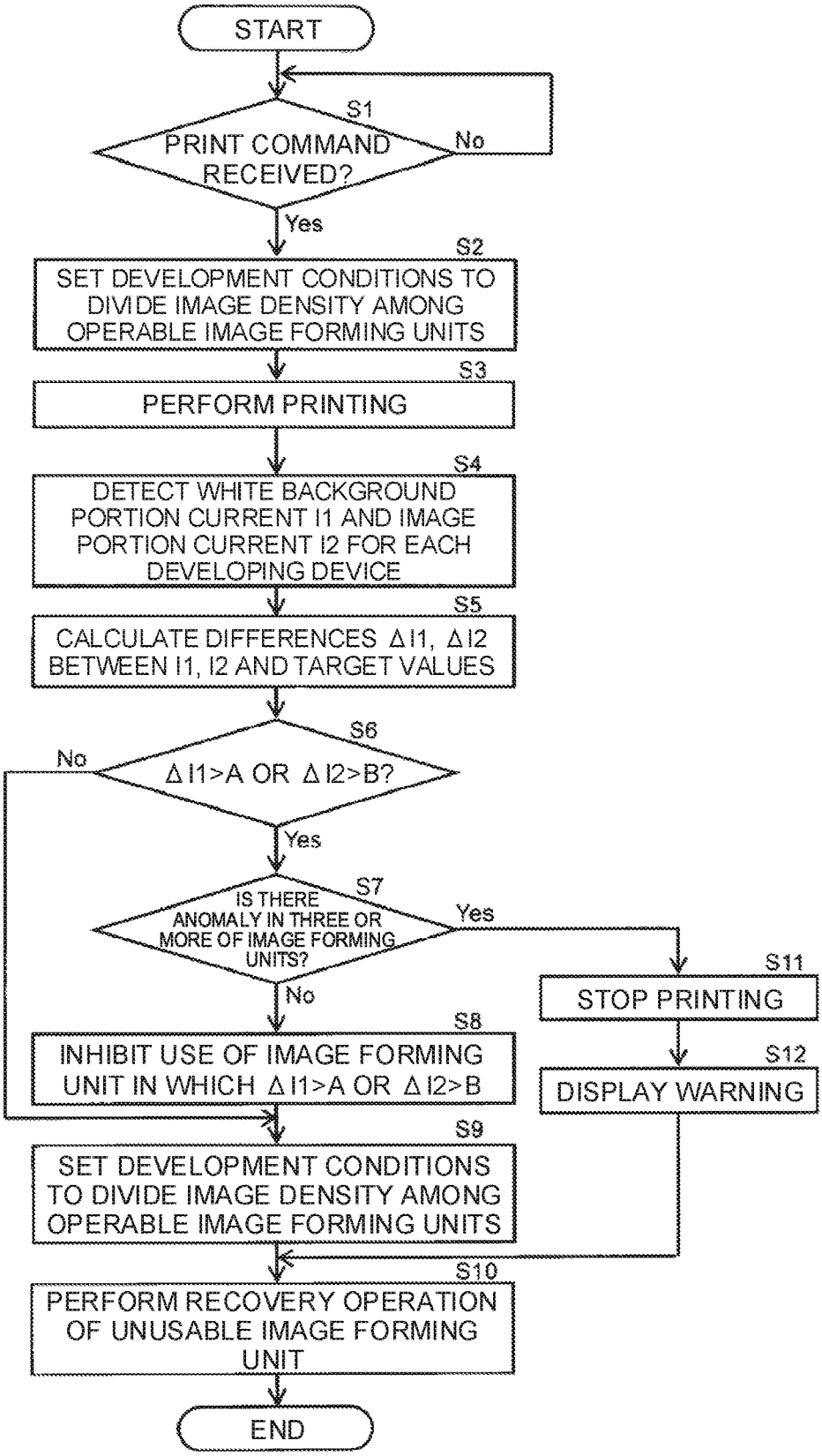
FIG. 4 is a flowchart showing an example of anomaly detection control of image forming units Pa to Pd in the image forming apparatus 100 according to the present embodiment.

FIG. 4 is a flowchart showing an example of anomaly detection control of the image forming units Pa to Pd in the image forming apparatus 100 according to the present disclosure. An anomaly detection procedure of the image forming units Pa to Pd is described in detail along the steps in FIG. 4 with reference to FIGS. 1 to 3 as necessary.

First, the main control unit 80 determines whether a print command is received (step S1). When the print command is received (Yes in step S1), development conditions are set to divide an image density among the operable image forming units Pa to Pd (step S2). Since all of the four image forming units Pa to Pd are normal at an initial stage of use of the image forming apparatus 100, development conditions (development potential difference Vdc−VL) of each of the developing devices 3*a* to 3*d* are set to divide the image density into four equal parts.

For example, when a target density (ID; image density) =0.8, the development potential difference Vdc−VL necessary for dividing the target density into four equal parts (ID=0.2) is set. In the present embodiment, when all of the four image forming units Pa to Pd are used, a DC voltage Vdc=250V of a developing voltage and a surface potential V0=350V are set. Then, printing is performed under the set development conditions (step S3).

Next, the main control unit 80 detects a DC component (white background portion current I1) of developing current flowing in a white background portion (non-exposed portion), and a DC component (image portion current I2) of developing current flowing in an image portion (exposed portion) with the current detection unit 44 for each of the developing devices 3*a* to 3*d* (step S4). The developing current is current flowing between the photoconductor drums 1*a* to 1*d* and the developing roller 31 by movement of toner, and is about 2 to 5 ρA.

Since the image density (toner development amount) is equally divided among the developing devices 3*a* to 3*d*, developing current flowing by toner movement is also substantially the same among the developing devices 3*a* to 3*d*. In a white background portion (a margin before and after an image and a portion between sheets of paper), toner present in a developing region moves from the photoconductor drums 1*a* to 1*d* side to the developing roller 31 side. At this occasion, if there is a defect in a surface potential or exposure, the white background portion current I1 changes. In an image portion, toner moves from the developing roller 31 to the photoconductor drums 1*a* to 1*d* side. At this occasion, if there is a defect in an electrostatic latent image or the developing devices 3*a* to 3*d*, the image portion current I2 changes.

Therefore, when the white background portion current I1 and the image portion current I2 of the developing devices 3*a* to 3*d* are measured, if there is a large deviation, it is possible to predict that a defect occurs in the image forming units Pa to Pd including the developing devices 3*a* to 3*d*. For example, when the image portion current I2 is excessively high, a black streak or the like may be generated in an image, and when the image portion current I2 is excessively low, a white streak or the like may be generated in an image.

Next, the main control unit 80 calculates a difference ΔI1 between the white background portion current I1 and a target value, and a difference ΔI2 between the image portion current I2 and a target value (step S5). As the target values of the white background portion current I1 and the image portion current I2, it is possible to use current values that are stored in advance in the storage unit 70 and are predicted from a relationship between a printing rate and developing current. The relationship between the printing rate and the developing current is shown in FIG. 5.

Alternatively, a reference pattern having a constant printing rate may be developed each time a specific number of prints is reached, and white background portion current and image portion current flowing during development may be measured and stored in the storage unit 70. Thus, it is possible to acquire a time change of white background portion current and image portion current. Then, it is possible to convert predicted values of the white background portion current and the image portion current that are predicted from the time change into a printing rate of an image to be actually formed, and set the printing rate as a target value.

Next, the main control unit 80 determines whether ΔI1 and ΔI2 calculated in step S4 are ΔI1>A or ΔI2>B (step S6). A and B are upper limit values of ΔI1 and ΔI2, respectively. A and B can be set to, for example, 30% of the target values. When either one of the white background portion current I1 and the image portion current I2 is deviated from the target value by 30% or more, specifically, ΔI1>A or ΔI2>B, the main control unit 80 determines that there is an anomaly in any of the image forming units Pa to Pd in which ΔI1>A or ΔI2>B.

When ΔI1>A or ΔI2>B in any of the image forming units Pa to Pd (Yes in step S6), the main control unit 80 determines whether there is an anomaly in three or more of the image forming units Pa to Pd (step S7). When there is an anomaly in two or less of the image forming units Pa to Pd (No in step S7), the main control unit 80 inhibits use of the image forming units Pa to Pd in which ΔI1>A or ΔI2>B (step S8).

Next, the main control unit 80 sets development conditions to divide an image density among the image forming units Pa to Pd that are operable at a present time (step S9). For example, when the target density ID=0.8, and ΔI1>A or ΔI2>B in the developing device 3*a*, the main control unit 80 inhibits use of the image forming unit Pa, and changes each of the target densities to ID=0.27 to divide the image density into three equal parts among the remaining image forming units Pb to Pd. Then, the main control unit 80 resets the development conditions of the developing devices 3*b* to 3*d*. The resetting method includes a method of changing the development potential difference Vdc−VL required to set ID=0.27 by calculation, and a method of performing calibration to reset Vdc−VL. In the present embodiment, when three of the developing devices 3*a* to 3*d* are used, a DC voltage Vdc=300V of a developing voltage, and a surface potential V0=400V are set.

On the other hand, in step S6, when ΔI1<A and ΔI2<B are satisfied in all the image forming units Pa to Pd (No in step S6), the development conditions are set to divide the image density into four equal parts among the operable four image forming units Pa to Pd (step S9).

For example, when the development conditions of the image forming units Pa to Pd are set to divide the image density into four equal parts in advance in step S2, it is not necessary to reset the development conditions. When it is determined that there is an anomaly in the image forming unit Pa in a previous printing operation, and the development conditions of each of the image forming units Pb to Pd are set to divide the image density into three equal parts, the development potential difference Vdc−VL, which is necessary for dividing the image density into four equal parts among the four image forming units Pa to Pd including the image forming unit Pa that becomes usable by a recovery operation, is changed by calculation, or calibration is performed by changing the target density to reset Vdc−VL.

Thereafter, when there are unusable image forming units Pa to Pd, the main control unit 80 performs a recovery operation of the image forming units Pa to Pd (step S10). For example, when the image forming unit Pa is unusable, it is presumed that the white background portion current I1 or the image portion current I2 of the developing device 3*a* is greater (or smaller) than that of the other developing devices 3*b* to 3*d* for some reason. Depending on a reason of change in the white background portion current I1 or the image portion current I2, it is possible to classify causes into those that are resolved by performing a specific recovery operation, and those that cannot be resolved even when a recovery operation is performed.

In view of the above, by performing a recovery operation according to a change in the white background portion current I1 or the image portion current I2, and detecting the white background portion current I1 and the image portion current I2 during a next image forming operation, it is possible to determine whether the image forming unit Pa that is determined to be anomalous is recovered.

As a specific example of the recovery operation, when the white background portion current I1 is lower (or higher) than a certain value, specifically, when the white background portion current I1 is out of a specific range, the surface potential of the photoconductor drum 1*a* may be lowered or raised. In view of the above, a refreshing (polishing) operation of the photoconductor drum 1*a* is performed.

On the other hand, when the image portion current I2 is lower (or higher) than a certain value, specifically, when the image portion current I2 is out of a specific range, a toner charge amount within the developing device 3*a* may be increased or decreased. In view of the above, an electrostatic latent image pattern (solid pattern) is formed on the photoconductor drums 1*a* to 1*d*, and a developing voltage is applied to the developing roller 31 to move (forcibly eject) toner on the developing roller 31 onto the photoconductor drums 1*a* to 1*d*. Thereafter, new toner is replenished from the toner containers 4*a* to 4*d*.

Further, when the toner charge amount is increased, it is also effective to use a method in which the developing devices 3*a* to 3*d* are kept stationary for a certain period of time to stabilize the toner charge amount. When the toner charge amount is decreased, it is also effective to use a method of lengthening the aging (stirring) time of a developer within the developing devices 3*a* to 3*d*. These recovery operations can be selected according to properties of toner for use.

Further, as a cause of the white background portion current I1 or the image portion current I2 being out of a specific range, a transport failure of a developer due to clogging of foreign matter in a gap (developer regulating portion) between the developing roller 31 and the regulation blade 27 is also conceived. In this case, a method of removing foreign matter by rotating the developing roller 31 in a reverse direction is also effective.

Then, when ΔI1<A and ΔI2<B are satisfied by the recovery operation, the development conditions are reset again together with the other image forming units Pb to Pd. When recovery is not possible even after the recovery operation is performed, the liquid crystal display unit 90 is notified to urge replacement of the photoconductor drum 1*a*, the developing device 3*a*, and the like, since it is necessary to replace the photoconductor drum 1*a*, the developing device 3*a*, and the like. Further, when it is determined that there is an anomaly in the image forming unit Pa, the photoconductor drum 1*a* and the developing device 3*a* may be replaced without performing the recovery operation.

Further, when there is an anomaly in three or more of the image forming units Pa to Pd (for example, image forming units Pa to Pc) in step S7 (Yes in step S7), an operable image forming unit among the image forming units Pa to Pd is only one (image forming unit Pd). In this case, since image quality cannot be guaranteed, printing is stopped (step S11). Then, a warning is displayed on the liquid crystal display unit 90 (step S12), a recovery operation of the image forming units Pa to Pc that are determined to be anomalous is performed (step S10), and the process is finished.

According to the control example shown in FIG. 4, in the image forming apparatus 100 in which the developing devices 3*a* to 3*d* are filled with toner of a same color and a same type to form an image, it is possible to easily and accurately detect an anomaly in the image forming units Pa to Pd by using the white background portion current I1 and the image portion current I2 flowing during image formation. Further, since it is not necessary to form a reference image for current detection when an image is not formed, it is possible to suppress consumption of toner during a period other than printing.

Then, by determining whether the image forming units Pa to Pd are usable based on a detection result, and setting development conditions of the usable image forming units Pa to Pd, it is possible to advantageously suppress image defects such as development ghost, image fog, and a transfer failure resulting from a change in the white background portion current I1 and the image portion current I2.

In addition, by performing a recovery operation for the image forming units Pa to Pd, which are determined to be unusable, it is possible to restore the image forming units Pa to Pd to a usable state. Thus, there is no likelihood that the recoverable photoconductor drums 1*a* to 1*d* and developing devices 3*a* to 3*d* may be replaced, and it is also possible to reduce the running cost of the image forming apparatus 100.

In the control example shown in FIG. 4, the recovery operation of the image forming units Pa to Pd, which are unusable, is performed after printing is finished. However, a timing of performing the recovery operation is not limited to the above. For example, the recovery operation may be performed between sheets of paper being printed. Alternatively, a dedicated recovery mode may be provided, and the recovery mode may be performed at any timing by input from the liquid crystal display unit 90 or a personal computer.

Further, in the above control example, the recovery operation is performed for the image forming units Pa to Pd in which ΔI1>A or ΔI2>B. However, as far as the white background portion current I1 or the image portion current I2 is higher (or lower) than a certain level, even when ΔI1<A and ΔI2<B are satisfied, the recovery operation may be performed. For example, when ΔI1 is A' (20% of the target value) or more, and ΔI2 is B' (20% of the target value) or more, a forcible ejection operation may be performed between sheets of paper being printed or after printing is finished, or a recovery operation such as lengthening the aging (stirring) time may be performed.

Further, determination as to whether the image forming units Pa to Pd that are unusable are recovered may be performed during normal image formation. However, by forming a reference image for determination between sheets of paper, it is possible to determine recovery of the image forming units Pa to Pd, and perform resetting of the development conditions after recovery without affecting a normal printing operation.

Other features of the present disclosure are not limited to the above embodiment, and various changes are available without departing from the spirit of the present disclosure. For example, in the above embodiment, as the target values of the white background portion current I1 and the image portion current I2, current values to be predicted from a relationship between a printing rate and developing current, which is stored in advance in the storage unit 70, are used. However, for example, it is also possible to use, as the target values, calculated average values of the white background portion current I1 and the image portion current I2 of each of the developing devices 3*a* to 3*d*.

However, when determination is made based on a difference with respect to average values of the white background portion current I1 and the image portion current I2, if an anomaly of developing current occurs in two or more of the image forming units Pa to Pd at the same time, a normal value may be deviated from the average values. In view of the above, it is preferable to determine whether there is an anomaly in the image forming units Pa to Pd by setting, as a target value, a current value to be predicted from a relationship between a printing rate and developing current as described above in the embodiment.

Further, in the above embodiment, an anomaly in the image forming units Pa to Pd is detected by using both of the white background portion current I1 and the image portion current I2. However, an anomaly in the image forming units Pa to Pd may be detected by using only one of the white background portion current I1 and the image portion current I2.

Further, in the above embodiment, the image forming apparatus 100 has been described by taking, as an example, a monochromatic printer in which the developing devices 3*a* to 3*d* are filled with black toner as shown in FIG. 1. However, the image forming apparatus 100 is not limited to a monochromatic printer and a monochromatic copying machine, and may be a color copying machine or a color printer provided with a plurality of developing devices for each color.

The present disclosure is applicable to an image forming apparatus that forms an image by filling a plurality of developing devices with toner of a same color and a same type. By using the present disclosure, it is possible to provide an image forming apparatus capable of easily and accurately detecting an image forming unit in which an anomaly has occurred, and advantageously suppressing occurrence of image defects.

What is claimed is:

1. An image forming apparatus comprising:

a plurality of image forming units each of which includes an image carrier having a photosensitive layer formed on a surface thereof, and a developing device including a developer carrier that is disposed to face the image carrier and carries a developer containing toner, and configured to form a toner image by adhering the toner to an electrostatic latent image formed on the image carrier, and forms an image by superimposing a toner image of a same color;

a developing voltage power supply that applies, to the developer carrier, a developing voltage acquired by superimposing an AC voltage on a DC voltage;

a current detection unit that detects a DC component of developing current that flows when the developing voltage is applied to the developer carrier; and a control unit that controls the image forming units and the developing voltage power supply, wherein the plurality of image forming units use the developer containing the toner of a same color and a same type, and substantially same development conditions are set to evenly divide an image density among the image forming units, the control unit detects whether there is an anomaly in each of the image forming units, based on at least one of white background portion current I1 being a DC component of developing current flowing through a non-exposed portion of the image carrier detected by the current detection unit during image formation, and image portion current I2 being a DC component of developing current flowing through an exposed portion of the image carrier, and when an anomaly is detected in any of the image forming units, the control unit inhibits use of the image forming unit, and resets the development conditions to evenly divide the image density among the usable image forming units.

2. The image forming apparatus according to claim 1, wherein the control unit determines that there is an anomaly in the image forming unit, when at least one of a difference ΔI1 between the white background portion current I1 and a target value, and a difference ΔI2 between the image portion current I2 and a target value is equal to or less than a lower limit value, or is equal to or greater an upper limit value.

3. The image forming apparatus according to claim 1, wherein the control unit determines that there is an anomaly in the image forming unit, when at least one of the white background portion current I1 and the image portion current I2 is deviated from an average value of the white background portion current I1 or the image portion current I2 of all the image forming units by a specific value or more.

4. The image forming apparatus according to claim 1, wherein the control unit performs a recovery operation of recovering the image forming unit in which an anomaly is detected.

5. The image forming apparatus according to claim 4, wherein the control unit performs a refreshing operation of polishing a photosensitive layer of the image carrier as the recovery operation, when the white background portion current I1 is out of a specific range.

6. The image forming apparatus according to claim 4, wherein the control unit performs a forcible ejection operation of ejecting the toner within the developing device onto the image carrier as the recovery operation, when the image portion current I2 is out of a specific range.

7. The image forming apparatus according to claim 4, wherein the control unit detects again at least one of the white background portion current I1 and the image portion current I2 of the image forming unit in which an anomaly is detected, and resets the development conditions to evenly divide the image density among the usable image forming units including the image forming unit, when the image forming unit is recovered by the recovery operation.

8. The image forming apparatus according to claim 4, further comprising a notification device that notifies a state of the image forming unit, wherein the control unit causes the notification unit to notify to urge replacement of the image carrier or the developing device within the image forming unit, when the image forming unit is not recovered after the recovery operation is performed.

9. The image forming apparatus according to claim 1, further comprising three or more of the image forming units, wherein the control unit stops an image forming operation, when the number of usable image forming units is one or less.

* * * * *